United States Patent [19]

Konishi et al.

[11] Patent Number: 4,529,189

[45] Date of Patent: Jul. 16, 1985

[54] SHEET FEEDING APPARATUS

[75] Inventors: Hiroshi Konishi; Makoto Shimizu, both of Tokyo, Japan

[73] Assignee: Oki Electric Industry Co., Ltd., Tokyo, Japan

[21] Appl. No.: 479,711

[22] Filed: Mar. 28, 1983

[30] Foreign Application Priority Data

Apr. 2, 1982 [JP] Japan ..... 57-53738

[51] Int. Cl.[3] ..... B65H 3/32

[52] U.S. Cl. ..... 271/22; 271/117; 271/161; 271/171

[58] Field of Search ..... 271/21, 22, 117, 240, 271/241, 253-255, 161, 171

[56] References Cited

U.S. PATENT DOCUMENTS

| | | | |
|---|---|---|---|
| 4,005,794 | 2/1977 | Lundquist | 271/161 |
| 4,098,501 | 7/1978 | Tani | 271/171 X |
| 4,168,829 | 9/1974 | Wilson | 271/171 X |
| 4,351,519 | 9/1982 | Jendrick | 271/117 |

*Primary Examiner*—Richard A. Schacher
*Attorney, Agent, or Firm*—Peter L. Berger

[57] ABSTRACT

The present invention is characterized in that the separating hook and hopper roller are adapted to be mounted on sheet guides of the hopper, one end of said sheet guide being adapted to be engaged in a groove of a pressure sleeve so as to make said pressure sleeve movable along said end. A movable shaft is adapted to pass through said pressure sleeve, and a spring is provided between said pressure sleeve and said sheet guide which biases the pressure sleeve to the hopper roller side, whereby at least the hopper roller, separating hook, pressure sleeve and spring at the print line end are made movable with the sheet guide being moved; thus by manually moving only one of the sheet guides, the sheet guides are made to meet right and left ends of the sheet, and the hopper roller is also made to select the correct position of the symmetrically central position of sheet width.

10 Claims, 10 Drawing Figures

SHEET FEEDING APPARATUS

SUMMARY OF INVENTION

In any type of printing machine, there are several different sizes of cut paper sheet such as A4, B4,B5, etc. for sheet feeding apparatus. Conventional sheet feeding apparatus is provided with hopper sheet guides which is prepared to move in a direction of almost right angle to the sheet advancing direction in accordance with the width of the sheet used therein. The present invention discloses a sheet feeding apparatus wherein a separating hook and hopper roller are adapted to be mounted on sheet guides of the hopper, with one of its ends being engaged in a groove of the pressure sleeve in such a manner as said pressure sleeve through which a movable shaft passes can move along the said end. Between said pressure sleeve and said sheet guide is provided a spring which biases said pressure sleeve to the hopper roller side whereby at least the hopper roller, separating hook, pressure sleeve and a spring provided at the print line end can move along the sheet guide in accordance with the sheet width. Thereby, the hopper roller can select the correct position by manually moving only one of the sheet guides in accordance with the sheet width. At the same time, the sheet can be pressed by biasing force equally balanced on right and left ends to simplify loading of the sheet. In addition, the print starting point is kept unchanged so that print control is done easily.

BACKGROUND OF INVENTION

A. Field of Invention:

The present invention relates to a sheet feeding apparatus prepared to be utilized for any type of printing machine wherein, by manually moving only one of the sheet guides adapted to be mounted on ends of a hopper in accordance with the sheet width so as to press a stack of sheets by a biasing force equally balanced on both the right and left ends.

B. Explanation of Prior Arts:

One of the best examples of prior art in the field of present invention is U.S. Pat. No. 3,883,133.

According to the said example, a sheet feeding apparatus includes: means for separating and advancing successive sheets from a stack of sheets disposed in a sheet feeding apparatus; a supporting member laterally movable from an operating position to loading position remotely spaced from the operating position; a base plate pivotably mounted on said supporting member, said base plate being adapted to support a stack of sheets; means for pivotably moving said base plate from a position remotely spaced from said means for separating and advancing successive sheets from a stack of sheets, to a position so as to be engaged in the means for separating and advancing the uppermost sheet from a stack of sheets, in response to said supporting member being moved from said loading position to said operating position; means for automatically locking said supporting member in the operating position; and means for automatically actuating the sheet feeding apparatus in response to said supporting member being located in said operating position.

However, in order to feed sheets straight forward without slanting, the hopper roller should be correctly mounted at a symmetrical point of the hopper, that is, at the very center of width of the sheets being stacked on the hopper.

According to said example, it is apparent that changing to different size sheets needs to be followed by manual moving both right and left sheet guides due to different sheet widths as well as changing of the selecting position so that the hopper roller is set at the very center of the sheet width. There is further demerit in a sheet feeding apparatus of said example, that is, the print control is complicated as the print starting position changes each time when the sheet size is changed.

The primary object of present invention is to automatically set the hopper roller in a correct position by manually moving only one of sheet guides of the hopper roller, and to press the sheet by a biasing force equally balanced on the right and left ends in communication therewith in order to securely feed the sheet straight forward.

A secondary object of present invention is to simplify the change of sheets to different sizes in association with hopper roller being moved to the correct positions by manually moving only one of sheet guides.

A thirdly object of present invention is to simplify the print control by keeping print starting position constantly same.

The above-mentioned characteristics and objects of present invention will become clear by reading the detailed explanation referring to attached drawings. The attached drawings, however, are intended to be used to explain present invention but not to limit the scope of the invention in any way.

DETAILED EXPLANATION OF PRESENT INVENTION

Figure 1:
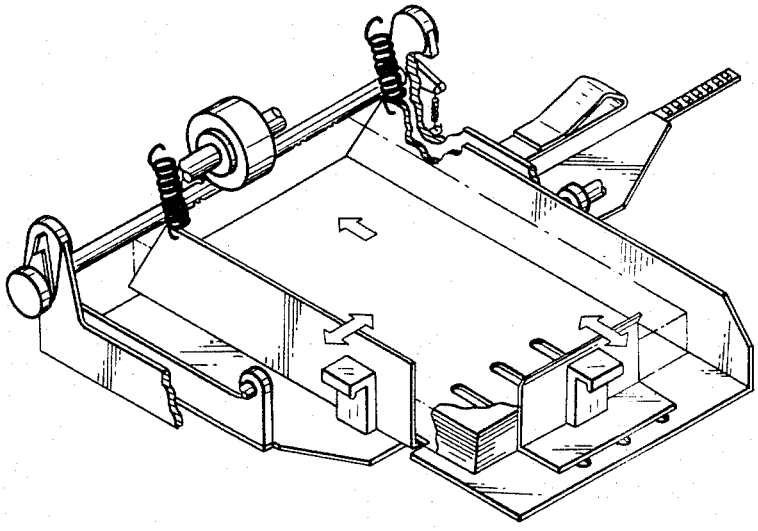
FIG. 1 Prior Art
FIG. 1 is a schematic perspective view of prior art.
Figure 2:
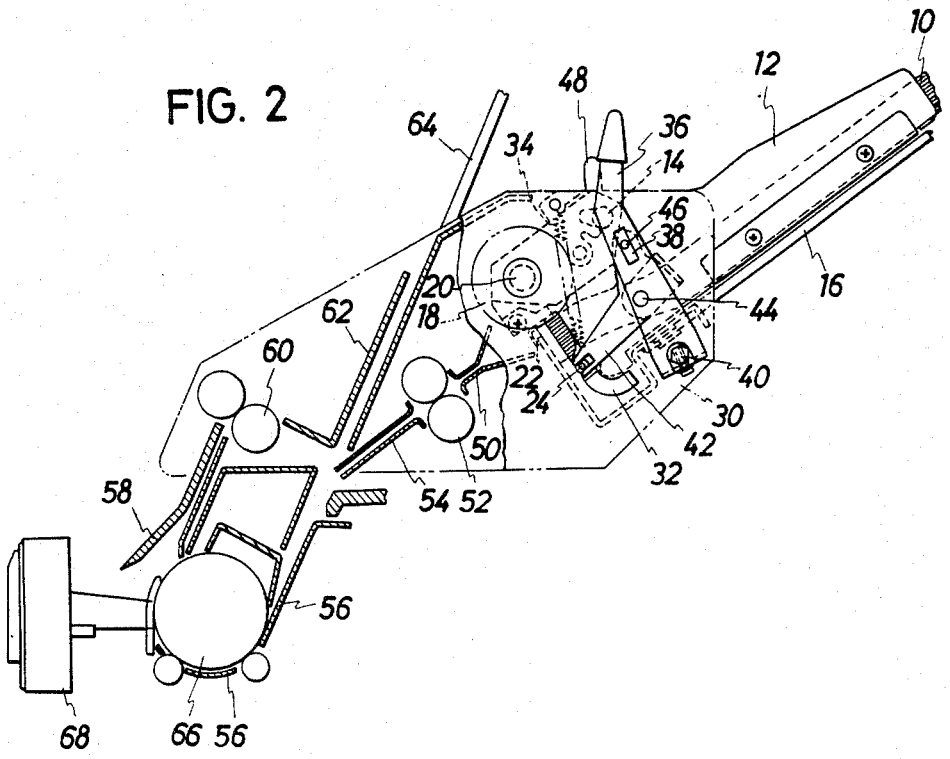
FIG. 2 is a side view illustrating one embodiment of the present invention.

Referring to FIG. 2 which shows a side view illustrating an embodiment of the present invention, numeral 10 indicates cut paper sheets. Numeral 12 indicates an L-shaped sheet guide adapted to support a stack of sheets 10. Numeral 14 indicates a guide shaft adapted to pivotably support sheet guide 12. Numeral 16 indicates an U-shaped hopper sheet support frame adapted to support the very center of width of sheet 10. Numeral 18 indicates a hopper roller adapted to be mounted on a drive shaft 20 in order to feed sheet 10, said hopper roller being rotated by said drive shaft.

A separating hook 22 is adapted to be mounted at the end of sheet guide 12, or provided unitedly therein.

Figure 7:
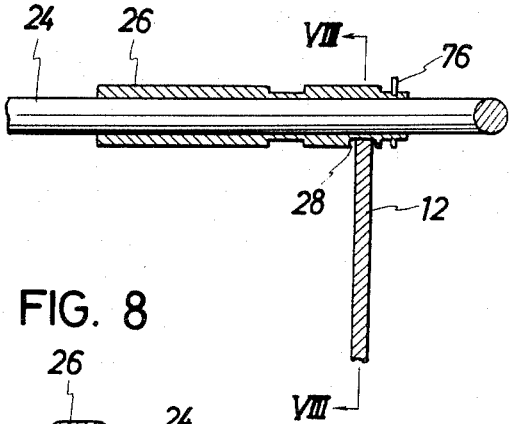
FIG. 7 is a cross-sectional view illustrating the combined state of sheet guides and movable shaft.

A movable shaft 24, as seen in FIG. 7, is covered by a pressure sleeve 26 having a groove 28 at one end which is engaged in one end of sheet guide 12 so as to move up and down along said end.

Numeral 30 indicates a side frame including an L-shaped long groove 32 provided to engage in movable shaft 24. A pressure spring 34 is engaged in sheet guide 12 at one end, the other end being engaged with movable shaft 24 in order to keep movable shaft 24 upward along long groove 32, as in FIG. 2.

Numeral 36 indicates a set lever I having long hole 38 adapted to be pivotably connected to a set lever shaft 40 which is mounted on side frame 30.

Numeral 42 indicates a set lever II. A post 46 provided at one end thereof is engaged in long hole 38 of set lever I 36 with a shaft 44 as the rotating shaft, to support movable shaft 24. A lock lever 48 locks sheet guide 12 by friction force caused when being pressed by guide shaft 14. Numeral 50 indicates a feed guide I. Numeral 52 indicates a feed roller I. Numeral 54 indicates a sheet feed guide II. Numeral 56 indicates a paper chute. Numeral 58 indicates a sheet feed guide. Numeral 60 indicates a feed roller II. Numeral 62 indicates stacker frame. Numeral 64 indicates a stacker sheet support frame. Numeral 66 indicates a platen, and numeral 68 indicates a print head.

Cut paper sheets are kept stacked on sheet guide 12. The front end of the stack of sheets is pushed upward by pressure sleeve 26, which presses the stack of sheets against hopper roller 18, whereby drive shaft 20 starts to feed sheets in seriatim.

Sheet 10, once fed, advances to feed guide I 50, and by way of feed roller I 52, and feed guide II 54, reaches paper chute 56. Thereafter sheet 10 passes between print head 68 and platen 66 when printing is done.

Sheet 10, once printed, advances to feed guide III 58, and by way of feed roller II 60, reaches a position being supported by both stacker frame 62 and stacker sheet support frame 64 where sheet 10 is stacked.

Figure 3:
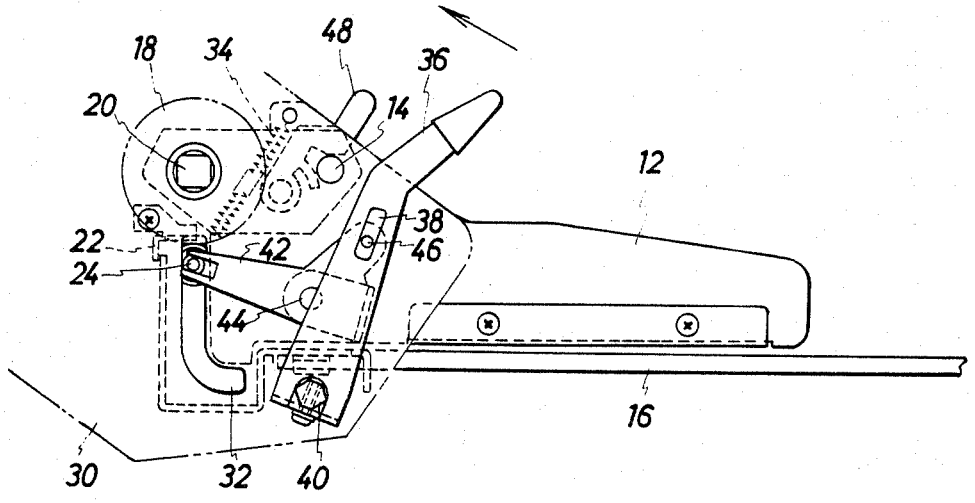
FIG. 3 is a fragmentary side view depicting a loading operation of a sheet.
Figure 4:
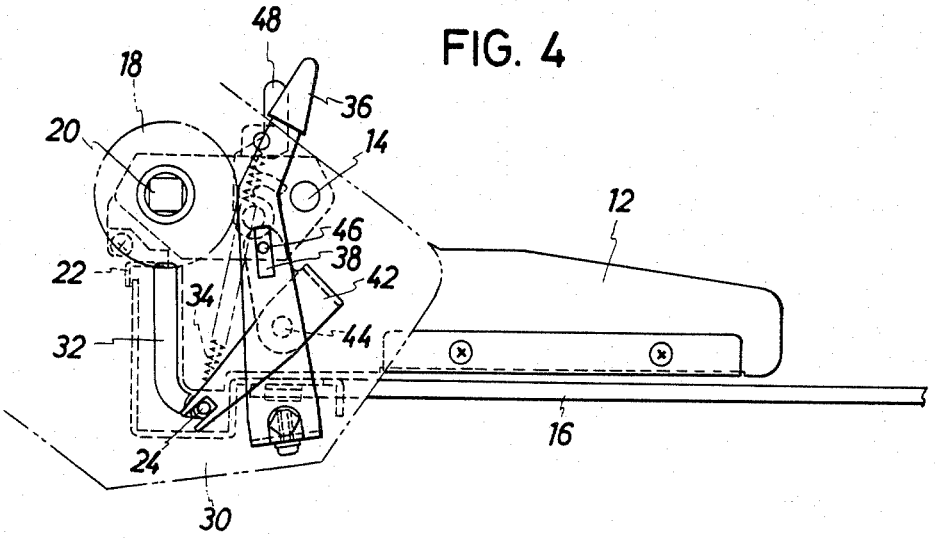
FIG. 4, as well as FIG. 3, is a fragmentary side view depicting a loading operation of a sheet.

Now turn to FIG. 3 and FIG. 4 illustrating the loading operation of a stack of sheets 10.

Numeral 36 indicates set lever I which, by being pulled in the direction of the arrow, rotates counter-clock-wise with lever shaft 40 as a pivot. Post 46, under reaction received through long hole 38, rotates set lever II 42 counterclockwise with shaft 44 as a pivot. Movable shaft 24 moves downward along long hole 32 in resistance to the biasing force caused by pressure spring 34 as in FIG. 3, in such a manner that movable shaft 24 stops at the lowest position of long hole 32 as seen in FIG. 4 and enough space is made between pressure sleeve 26 and hopper roller 18 where a stack of sheets 10 is loaded easily.

Upon loading a stack of sheets 10 of required size, set lever I 36 is pushed in the opposite direction to that of the arrow whereby movable shaft 24 moves upward in FIG. 4, due to the biasing force of spring 34.

As a result, the front end of stack 10 is held up by pressure sleeve 26, and the stack of sheets 10 is pressed against hopper roller 18.

As seen clearly from the above explanation, pressure spring 34 functions as a kind of detent spring to stop movable shaft 24 at its uppermost and lowermost ends of long hole 32.

Figure 5:
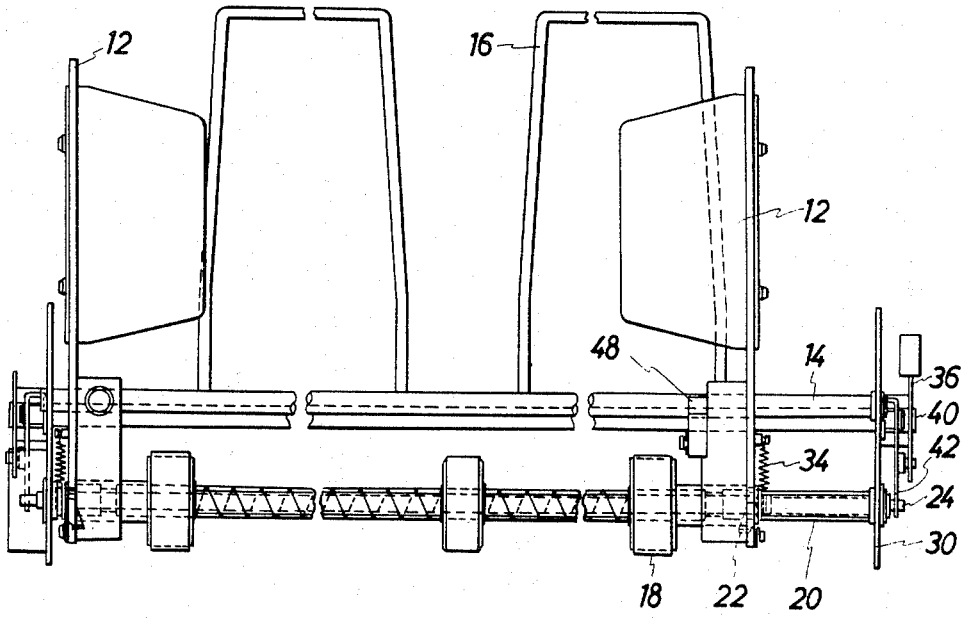
FIG. 5 is a plane view depicting the position selecting operation of sheet guides.

Now move to FIG. 5 illustrating the position selecting operation of sheet guide in accordance with sheet width.

Start with pulling down lock lever 48 to this side, that is, releasing the lock by rotating lock lever 48 counterclockwise in FIG. 2, which makes right sheet guide 12 of FIG. 5 movable along guide shaft 14 and drive shaft 20.

Next, push a stack of sheets 10 to left sheet guide 12 and move right sheet guide 12 leftward. When the side plate of right sheet guide 12 has fully pushed a stack of sheet 10 leftward, push lock lever 48 backward, that is, rotate lock lever 48 clockwise in FIG. 2 until it is pressed by guide shaft 14 so as to be locked by friction force. Said lock lever 48 is made of elastic plastics and is transformed by this operation.

Figure 6:
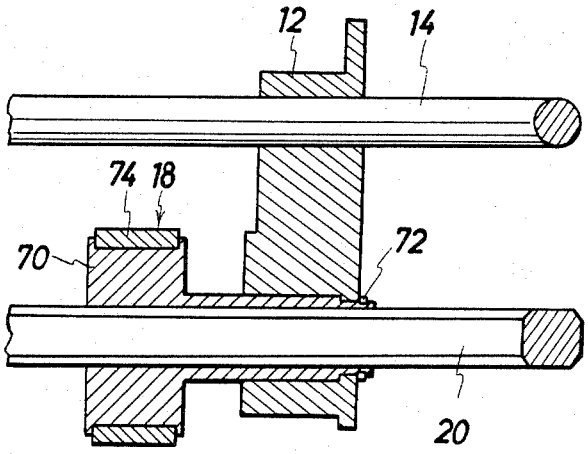
FIG. 6 is a cross-sectional view illustrating the combined state of sheet guides and hopper roller.

FIG. 6 shows a side view illustrating the combined members of sheet guide 12 with hopper roller 18. Elevationally octagonal drive shaft 20 is passed through a hopper roller sleeve 70 provided with elevationally octagonal hole. Sheet guide 12 is adapted to pass through said hopper roller sleeve 70 and guide shaft 14, said hopper roller sleeve 70 being provided with a snap ring 72 to prevent slip-off.

On the circumferential surface of hopper roller sleeve 70, is attached a rubber ring 74 having cogs. Hopper roller 18 consists of said hopper roller sleeve 70 and rubber ring 74 having cogs.

FIG. 7 shows a side view illustrating combined members of sheet guide 12 with movable shaft 24. Movable shaft 24 is adapted to pass through pressure sleeve 26, one end of sheet guide 12 being engaged in a groove of said pressure sleeve 26, whereby pressure sleeve 26 can move up and down with movable shaft 24 along said end of sheet guide 12. In accompaniment of sheet guide 12, pressure sleeve 26 can move in a direction of almost right angle to sheet advancing direction (or printing direction here). At one end of pressure sleeve 26 is provided spring hook 76, which is engaged with one end of pressure spring 34.

When sheet guide 12 is moved, pressure spring 34 moves automatically in accompaniment therewith. Consequently, pressure spring 34 gives equally balanced biasing force to places equally spaced from both ends of sheet 10. It is important in view of the fact that it prevents sheet 10 from advancing on a slant.

Figure 8:
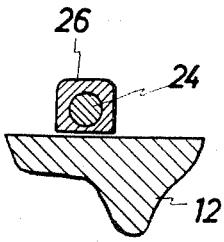
FIG. 8 is a cross-sectional view along a line VIII—VIII of FIG. 7.

FIG. 8 shows a cross-sectional view at line VIII—VIII of the element shown in FIG. 7. FIG. 8 shows that pressure sleeve 26 rotates freely against movable shaft 24 but its rotation is controlled by sheet guide 12.

Figure 9:
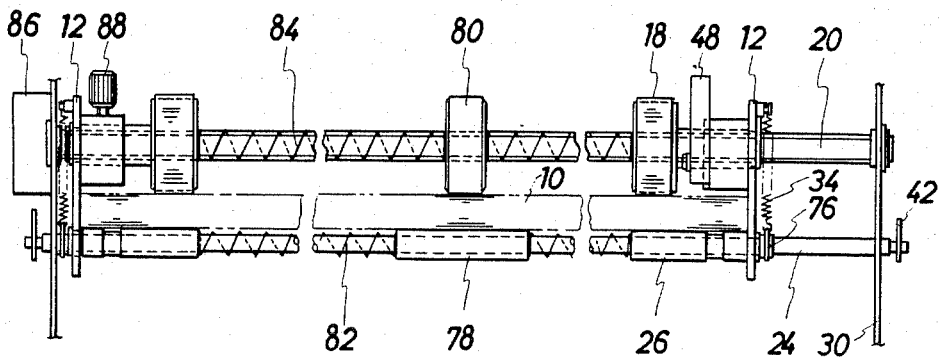
FIG. 9 is a back view as seen from the rear side illustrating the pressed state of sheet.

FIG. 9 shows a back view as seen from the rear side in order to show the pressed state of the stack of sheets 10. It shows that hopper roller 18 and pressure sleeve 26 press a stack of sheets 10 in places equally spaced from right and left ends of sheet 10. Since pressure roller 78 and sub-pressure roller 80 receive biasing force from right and left spacer spring 82 and 84 respectively, movement of sheet guide 12 causes pressure roller 78 and sub-pressure roller 80 to automatically move to the center of sheet width. Drive shaft 20 is connected to a motor (unshown) by way of an electromagnetic clutch 86.

According to the present embodiment, left sheet guide 12 is made movable by loosening lock screw 88, whereby the print starting position is changed in accordance with the printing format. It enables to adjust delicate printing position at one end of sheet 10.

Figure 10:
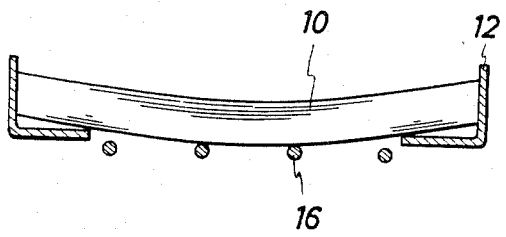
FIG. 10 is a cross-sectional view illustrating the positional relationship between the sheet guides and hopper sheet support frame.

Now move to FIG. 10 which shows present embodiment more clearly. The height difference is provided between bottom plate of sheet guide 12 and hopper sheet support frame 16 so as to hold a stack of sheet 10 curvedly with both ends being held up. A stack of sheet 10 become stiffer consequently so that comparatively short hopper sheet support frame 16 can support long sheet 10.

According to the present invention described above, by manually moving only one of sheet guides 12 in accordance with sheet width, the sheet is pressed by biasing force equally balanced on right and left ends and hopper roller 18 is moved to a correct position in such a manner that said sheet advances straight forward and loading of a stack of sheet 10 is done easily at the same time. In addition, the print starting position is kept unchanged so that the print control is also done easily.

What is claimed is:

1. A sheet feeding apparatus for a printing machine comprising a hopper comprising at least one pair of spaced apart sheet guides, said sheet guides movable substantially at right angles to the sheet advancing direction, said sheet guides provided with separating hooks and hopper rollers for removing individual sheets from a stack of sheets carried in said hopper, a pressure sleeve inserted in and assembled with a movable shaft so as to move with the sheet guides, said pressure sleeve comprising grooves to be engaged with the distal ends of said sheet guides to be moved upwardly and downwardly with said pressure sleeve, each of said hopper rollers being spaced the same distance from the right and left sheet guides so as to pressure the sheets equally on the right and left sides of said sheets, further comprising a drive shaft located above said sheets of paper, said pressure sleeve located below said sheets of paper, means carried on said drive shaft and said pressure sleeve to flatten said sheets as they are carried on said hopper.

2. A sheet feeding apparatus as claimed in claim 1, further comprising a biasing spring connected between said pressure sleeve and said sheet guide to move said pressure sleeve toward said hopper, said hopper rollers separating hooks, pressure sleeve and said spring all moving with said sheet guide.

3. A sheet feeding apparatus as claimed in claim 1, wherein said means to flatten comprises a subpressure roller carried on said drive shaft and a pressure roller carried on said pressure sleeve below said subpressure roller.

4. A sheet feeding apparatus as claimed in claim 3, wherein said subpressure roller and said pressure roller are spring biased to be centered on the respective drive shaft and pressure sleeves.

5. A sheet feeding apparatus as claimed in claim 4, wherein said centered pressure and subpressure rollers are centered with respect to said sheets independent of the width of the sheets carried on said spaced-apart sheet guides.

6. A sheet feeding apparatus as claimed in claim 2, wherein said biasing spring located with respect to each of said sheet guides provides equal biasing to both sides of said sheet as said hopper is operated to equalize the force on each side of the sheet feeding apparatus to minimize slant feeding of said sheets.

7. A sheet feeding apparatus as claimed in claim 2, further comprising a locking screw operatively connected with one of said sheet guides to permit movement of said sheet guide to adjust the print starting position of said sheet.

8. A sheet feeding apparatus as claimed in claim 1, wherein only one of said sheet guides is moved transversely to the direction of feed of said sheets to adjust for the side of the sheet to be held in said hopper.

9. A sheet feeding apparatus for a printing machine comprising a hopper comprising at least one pair of spaced apart sheet guides, said sheet guides being movable substantially at right angles to the sheet advancing direction to accommodate sheets of various widths placed in the hopper, and at least one pair of sheet guide assemblies, each sheet guide assembly being mounted on a sheet guide and comprising a separating hook, a hopper roller and means for pressing a stack of sheets against the hopper roller, said sheet guide assemblies being movable substantially at right angles to the sheet advancing direction.

10. A sheet feeding apparatus as claimed in claim 9 wherein the means for pressing a stack of sheets against the upper roller comprises a pressure sleeve slidably secured on a movable shaft, said pressure sleeve including means for engaging an end of the sheet guide for movement of the pressure sleeve along the end of the sheet guide, side frames each having an L-shaped groove for guiding both ends of the movable shaft along the L-shaped grooves, and a biasing spring tensioned between said pressure sleeve and said sheet guide for drawing said pressure sleeve towards said hopper roller.

* * * * *